US008740423B1

(12) United States Patent
Jackson

(10) Patent No.: US 8,740,423 B1
(45) Date of Patent: Jun. 3, 2014

(54) UNIT FOR USE IN PLACING AND ORIENTING GROUND LIGHT SUPPORTING STAKE ELEMENTS

(76) Inventor: Warren Michael Jackson, Zirconia, NC (US)

( * ) Notice: Subject to any disclaimer, the term of this patent is extended or adjusted under 35 U.S.C. 154(b) by 0 days.

(21) Appl. No.: 13/447,296

(22) Filed: Apr. 16, 2012

(51) Int. Cl.
*F21S 8/00* (2006.01)
*F21V 33/00* (2006.01)

(52) U.S. Cl.
USPC ..... 362/431; 362/253

(58) Field of Classification Search
USPC ..... 362/153, 153.1, 431, 253; 52/155; 135/118; 173/1
See application file for complete search history.

(56) References Cited

U.S. PATENT DOCUMENTS 5,256,006 A * 10/1993 Harding ..... 405/255
D453,388 S 2/2002 Leen
6,461,018 B1 10/2002 Chanslor
7,938,565 B2 5/2011 Richard
2006/0262542 A1 11/2006 Ibbitson et al.
2007/0091598 A1 4/2007 Chen
2008/0049605 A1 2/2008 Balger
2009/0122564 A1 5/2009 Beadle
2010/0085742 A1 4/2010 Ip

* cited by examiner

*Primary Examiner* — Thomas Sember
(74) *Attorney, Agent, or Firm* — RG Patent Consulting LLC; Rachel Gilboy

(57) ABSTRACT

A unit that fits on a supporting stake that is used to support a landscape light. The unit is placed over the light supporting stake during placement of the stake into the ground and indicates whether or not the stake is level. The unit includes a sleeve that can absorb hammer impacts so the stake can be driven into the ground with the level-indicator in place whereby the levelness of the impact-receiving face of the ground light supporting stake can be monitored as the ground light supporting stake is driven into the ground so that the stake will be level without requiring a torpedo level on the side of the light. Once the stake is in place, the unit is removed and the light associated with the stake is placed on the stake.

5 Claims, 4 Drawing Sheets

UNIT FOR USE IN PLACING AND ORIENTING GROUND LIGHT SUPPORTING STAKE ELEMENTS

TECHNICAL FIELD OF THE INVENTION

The present invention relates to the general art of tools, and to the particular field of hand tools.

BACKGROUND OF THE INVENTION

Outdoor lighting fixtures have been widely adopted for illuminating buildings, gardens, pathways, and entrance ways as the nighttime play of light on the landscape and vegetation can aesthetically pleasing as well as providing sufficient light for safely navigating an otherwise dark walkway. Additionally, such lighting provides enhanced security by eliminating hiding places and unobserved entry points for intruders. The most widely used outdoor lighting systems include one or more low voltage lighting fixtures that are connected to a 12 V transformer that is, in turn, connected to a standard 120 VAC line. Other types of lighting that are gaining popularity are solar powered, where the fixtures are connected by a cable to a solar collector panel that is located at a sunny location during daylight hours. Each lighting fixture generally includes housing, a lamp assembly having a halogen or conventional incandescent bulb and a reflector, and a lens or window. Many configurations are known for providing a variety of different lighting effects.

There are many gardens around the world that are meticulously well kept with many varieties of vegetation. People absorb the natural beauty and find comfort in the serene surroundings. Impressively large trees can be right next to small delicate plants. Gardens themselves can be massive in size, taking up many city blocks, or just a few square feet near a person's home. In any circumstance, once the sun goes down, these gardens are often bathed in darkness.

To combat this darkness, people have placed lights in their gardens, which can often have a dramatic effect. Further, signs have also been used in gardens to indicate particular directions or paths to those in the garden. In recent years, a popular product for homeowners has been a system of lights that are used to light a walkway leading up to the front door of a residence, to accent the border of a patio or outdoor space, or to decorate a yard or a garden. Others use the lights near a walkway as a safety precaution to properly direct those using the walkway onto its hard surface. These systems of lights are designed to use the commonly available 120 v AC electrical energy found in most U.S. residences.

Fixed light assemblies utilize conventional line voltage, which 120 v AC electrical energy commonly found in most U.S. residences. Fixed outdoor lighting line voltage assemblies are relatively permanent as such assemblies are built into walls, stairs or posts where varying inclinations of the light source produces directional or aesthetic effects. Such fixed light assemblies are expensive to manufacture as they require a weatherproofed construction for the outdoor application such as additional insulation, gaskets or other adaptations in order to operate in various weather conditions. Fixed light assemblies also have the additional cost associated with installation by the homeowner or professionals to local electrical codes.

Other outdoor line, light assemblies can be configured as portable, which are useful in applications requiring changing various aspects such as the location and/or the inclination of illumination.

Many outdoor lighting fixtures that are intended to be located at or slightly above ground level are provided with spikes that can be driven into the ground to provide an inexpensive and stable base for supporting the light. Other outdoor lighting systems feature a series of ground mounted holders or stakes having light bulbs and electrical cords extending therethrough or otherwise coupled thereto. The holders and bulbs, with their accompanying electrical cords are typically installed as a single, combined unit. Installation of such combined units often involves pressing the holders into the ground or digging a hole, installing the holders, then covering a portion of the holders with dirt or other material. Ground-mounted light-holding stakes can also be difficult to insert into the ground, such as in rough or rocky terrain.

In order to be most effective, ground-mounted light-holding stakes must be oriented so that the lights mounted thereon are level. Driving these stakes into the ground thus further requires that steps be taken so that the stake will support the light in a desired, level, manner. This problem is exacerbated when the ground is hard or contains rocks.

Currently, the means known to the inventor which are used to establish the desired orientation require the worker placing the stake to place a torpedo level on the stake to monitor the orientation of the stake. This is time consuming, especially if there are a great number of lights to be installed.

Accordingly, there is a need for an efficient means to monitor the orientation of a ground light supporting stake element during placement of that element.

SUMMARY OF THE INVENTION

The above-discussed disadvantages of the prior art are overcome by a unit that is used to monitor the levelness of a ground light supporting stake as that stake is driven into the ground. The unit includes a sleeve having two blind-ended bores, an impact-transferring surface defining a bottom wall of a first bore of the two bores, and an impact-receiving rim located around an opening into the second blind-ended bore of the two bores. A top end of the ground light supporting stake is accommodated in the first bore in abutting relationship to the bottom wall to receive impact force from an impact-delivering tool, such as a hammer, via the sleeve to drive that stake into the ground. A bubble level unit is accommodated in the second bore to be visible via the opening during the operation of driving the stake into the ground whereby the levelness of an impact-receiving face of the ground light supporting stake can be monitored as the ground light supporting stake is driven into the ground so that the stake can be maintained level without requiring a torpedo level on the side of a light. Once the stake is in place, the unit is removed and is replaced with a ground light.

Using the unit embodying the present invention will permit a worker to quickly, efficiently and accurately install landscape or ground lights.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 1:
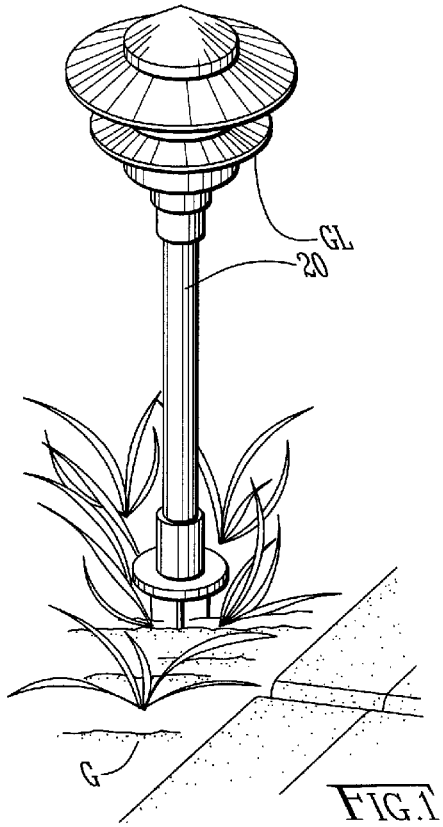
FIG. 1 is a perspective view of a ground light supported on a ground light supporting stake element that has been driven into the ground and oriented using the unit embodying the present invention.
Figure 2:
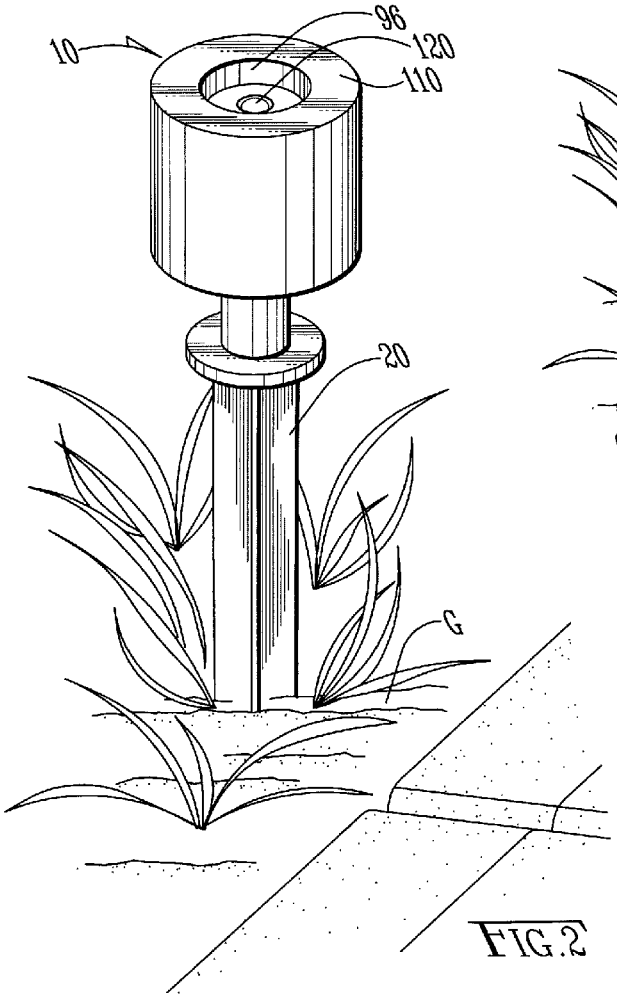
FIG. 2 is a perspective view of a ground light supporting stake element having the unit embodying the present invention in place thereon during placement thereof.
Figure 3:
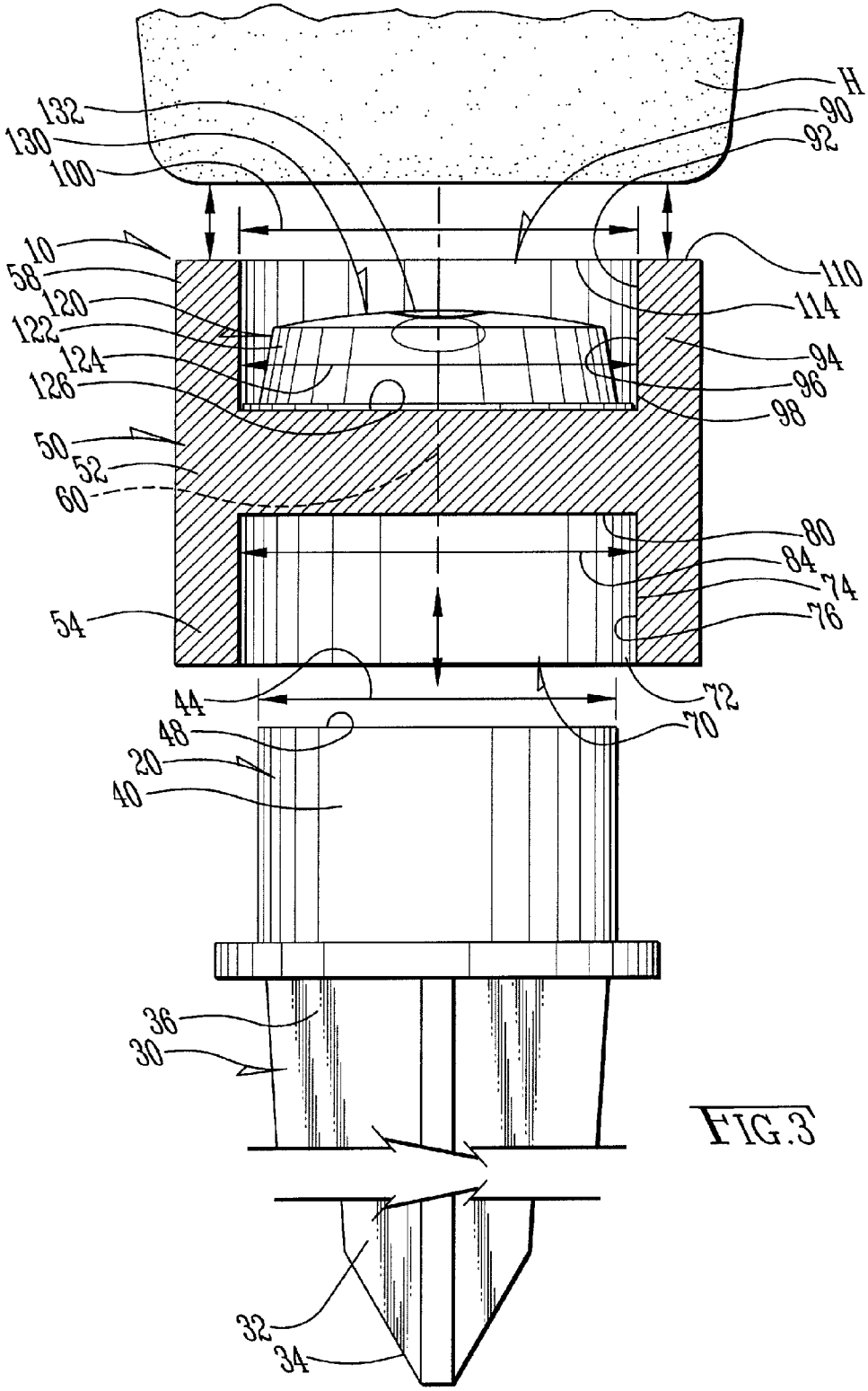
FIG. 3 is a schematic showing the unit of the present invention in combination with a ground light supporting stake element and an impact-delivering tool.
Figure 4:
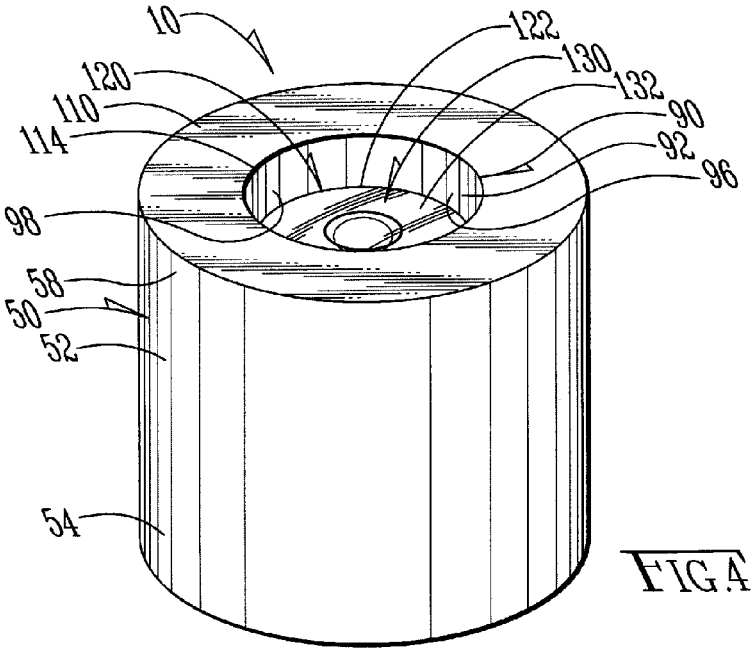
FIG. 4 is a top perspective view of the unit of the present invention.
Figure 5:
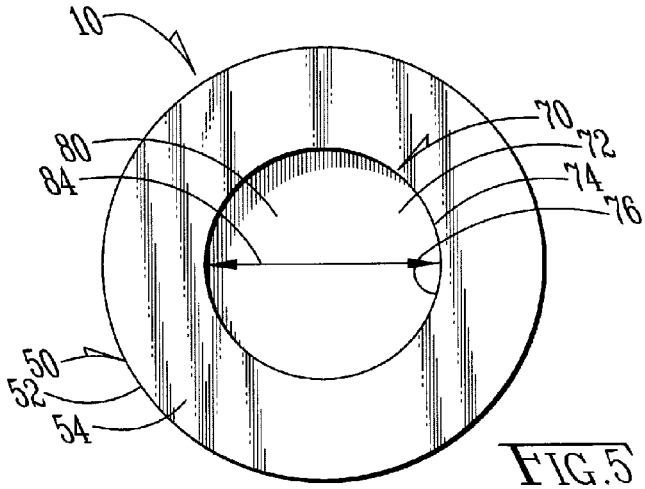
FIG. 5 is a bottom plan view of the unit of the present invention.
Figure 6:
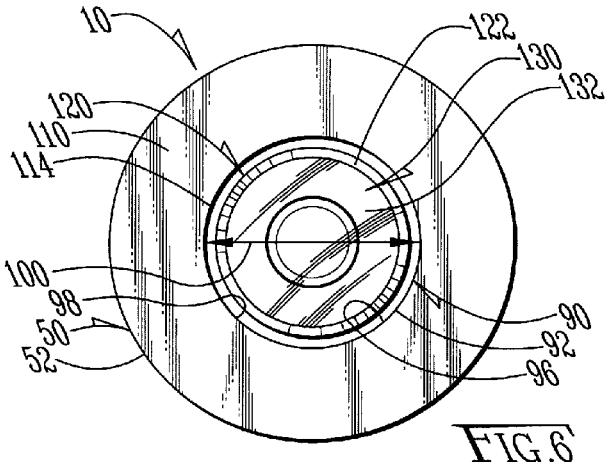
FIG. 6 is a top plan view of the unit of the present invention.

Referring to the figures, it can be understood that the present invention is embodied in a unit 10 which is used to drive a ground light supporting stake element 20 which, as shown in FIG. 1, supports a ground light GL above ground G when in use. Referring to FIG. 3, it can be understood that element 20 includes a tapered body 30 which can be formed of any material that is suitable for being driven into the ground and which will reliably support ground light GL in a manner known to those skilled in the art. Body 30 is tapered and includes a first end 32 which leads the stake element into the ground when the stake unit is forced into the ground, a pointed end 34 on the first end of the tapered body, and a second end 36 on the tapered body which is located above ground when the stake element is in use supporting a ground light. A cylindrical section 40 is located on the second end of the tapered body and which is located above ground when the stake element is being driven into the ground for use. As will be understood from the drawings, cylindrical section 40 has an outer dimension 44. An impact-receiving planar face 48 is located on the second end of the tapered body.

More specifically, unit 10 includes a tubular sleeve element 50. Element 50 has a cylindrical body 52 which includes a first end 54 on the cylindrical body which is located adjacent to second end 36 of the tapered body of the stake element when the stake element setting element is in use transferring impact from the impact-delivering tool to the stake element when the stake element is being driven into the ground. Body 52 further includes a second end 58 which is located to receive impact from the impact-delivering tool when the stake element is being driven into the ground, and has a longitudinal axis 60 which extends between the first end on the cylindrical body and the second end on the cylindrical body.

A first blind-ended bore 70 is defined in the cylindrical body adjacent to the first end of the cylindrical body and extends from the first end of the cylindrical body toward the second end of the cylindrical body in the direction of the longitudinal axis of the cylindrical body. A first cavity 72 is defined by the first blind-ended bore and the cylindrical body has a side wall 74 with an inner surface 76 located in the first cavity. A planar impact-transferring wall 80 extends across the longitudinal axis of the cylindrical body. Planar wall 80 is adapted to abut impact-receiving planar face 48 when the ground light supporting stake element setting element is in place on the ground light supporting stake element as shown in FIG. 1 for use in transferring impact from the impact-delivering tool to the ground light supporting stake element to drive that stake element into the ground. First cavity 72 has an inner dimension 84 as defined by the inner surface of the side wall of the first cavity which is larger than outer dimension 44 of the cylindrical section on the second end of the tapered body of the ground light supporting stake element so cylindrical section 40 of the stake element is accommodated in first cavity 72 during use of the ground light supporting stake element setting element to drive the stake element into the ground.

A second blind-ended bore 90 is defined in the cylindrical body adjacent to second end 58 of the cylindrical body. Second blind-ended bore 90 extends from second end 58 of the cylindrical body toward first end 54 of the cylindrical body in the direction of the longitudinal axis of the cylindrical body. A second cavity 92 is defined by the second blind-ended bore with the cylindrical body having a side wall 94 with an inner surface 96 located in the second cavity. A planar wall 98 extends across the longitudinal axis of the cylindrical body, with inner surface 96 of the side wall of the second cavity having an inner dimension 100.

An annular impact-receiving rim 110 is defined by the second end of the cylindrical body adjacent to the second blind-ended bore and is adapted to receive impact from the impact-delivering tool when the ground light supporting stake element setting element is in use transferring impact from the impact-delivering tool to the ground light supporting stake element.

An opening 114 into second cavity 92 defined by the annular impact-receiving rim defined by the second end of the cylindrical body, and is used to view into that second cavity as will be understood from the teaching of this disclosure.

A bubble level unit 120 is accommodated in the second cavity of the tubular sleeve element and indicates the degree of levelness of the tubular sleeve element when the tubular sleeve element is in use transferring impact from the impact-delivering tool to the stake element. The bubble level unit includes a cylindrical body 122 having an outer dimension 124 which is less than inner dimension 100 of the second cavity so the bubble level unit is accommodated in the second cavity during use of the ground light supporting stake element setting element to transfer impact from the impact-delivering tool to the ground light supporting stake element. Bubble level unit 120 further includes a planar wall 126 which abuts planar wall 98 of the second cavity when the bubble level unit is in place in the second cavity. A bubble level system 130 is located in the cylindrical body, and a bubble viewing surface 132 is located on the cylindrical body of the bubble level unit through which the bubble level system is viewed to determine levelness.

Bubble level unit 120 is located in the second cavity to be visible through opening 114 defined by the annular impact-receiving rim on the second end of the cylindrical body during use of ground light supporting stake element setting element to drive the ground light supporting stake into the ground whereby the levelness of the impact-receiving face of the ground light supporting stake can be monitored as the ground light supporting stake is driven into the ground.

As can be understood from the figures, unit 10 is placed on stake 20 and tool H is used to drive stake 20 into the ground. During this operation, bubble level unit 120 is viewed through opening 114 to ensure that the stake is being driven into the ground in a manner which maintains surface 48 level. Once stake 20 is driven into the ground, unit 10 is removed and ground light GL is secured to the stake in the known manner. The details of ground light GL and any elements associated with the operation of the ground light are known to those skilled in the art and thus will not be discussed.

Figure 7:
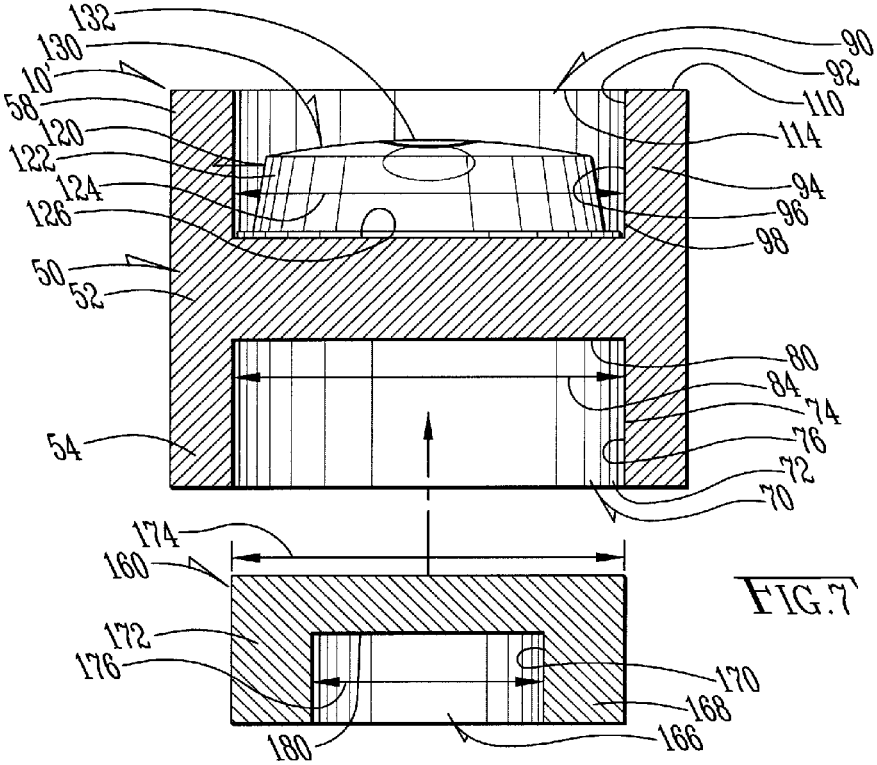
FIG. 7 is a schematic showing a form of the unit of the present invention in conjunction with an adapter used to adapt the size of the unit to a stake which is smaller than the stake shown in FIG. 3.

In the event that stake 120 is smaller than cavity 72, an adapter element 160 can be used so unit 10 can be securely attached to the smaller stake. Adapter element 160 is shown in FIG. 7 as being located in cavity 72 to be interposed between the ground light supporting stake element and the body for adapting the size of the ground light supporting stake element setting unit to the size of a ground light supporting stake element. Adapter element 160 corresponds to cavity 72 and includes a tubular body 172 having an outer dimension 174 that is smaller than inner dimension 84 of cavity 72 so the adapter element fits into cavity 72. Adapter element 160 further includes a blind-ended bore 166 which includes a wall 168 having an inner surface 170 that defines a cavity 178 having an inner dimension 176. Inner dimension 176 is sized to accommodate the second end of a small stake to securely attach unit 10 to that smaller stake. A planar impact-transferring wall 180 is located to abut the impact-receiving planar face of the small stake. Once the adapter element is in place in unit 10, operation of the unit/adapter 10' shown in FIG. 7 is identical to that described above with reference to unit 10.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A ground light supporting stake element setting unit which is used to transfer impacts from an impact delivering tool, to a ground light supporting stake element to drive the ground light supporting stake element into the ground and which includes:

A) a body which is sized to be accommodated on the ground light supporting stake element to be interposed between the impact delivering tool and the ground light supporting stake element and to receive impact from the impact delivering tool when the ground light supporting stake element setting unit is in use to drive the ground light supporting stake into the ground;

B) a bubble level unit positioned in the body to be visible when the ground light supporting stake element setting unit is in use to drive the ground light supporting stake into the ground whereby the levelness of an impact receiving face of the ground light supporting stake can be monitored as the ground light supporting stake is driven into the ground and C) an adapter element which is interposed between the ground light supporting stake element and the body for adapting the size of the ground light supporting stake element setting unit to the size of a ground light supporting stake element.

2. A ground light supporting stake element setting unit which is used to transfer impacts from an impact delivering tool to a ground light supporting stake element to drive the ground light supporting element into the ground and which includes:

(1) a tubular sleeve element which has (a) cylindrical body, (b) a first end on the cylindrical body which is located adjacent to an end of the stake element when the stake element setting element is in use transferring impact from the impact delivering tool to the stake element when the stake element is being driven into the ground, (c) a second end on the cylindrical body which is located to receive impact from the impact delivering tool when the stake element is being driven into the ground, (d) the cylindrical body having a longitudinal axis extending between the first end on the cylindrical body and the second end on the cylindrical body, (e) a first blind ended bore defined in the cylindrical body adjacent to the first end of the cylindrical body, the first blind ended bore extending from the first end of the cylindrical body toward the second end of the cylindrical body in the direction of the longitudinal axis of the cylindrical body, (f) a first cavity defined by the first blind ended bore, the cylindrical body having a side wall with an inner surface located in the first cavity and a planar wall extending across the longitudinal axis of the cylindrical body, (g) the planar wall of the first cavity being adapted to abut an impact receiving planar face located on the ground light supporting stake element when the ground light supporting stake setting element is in place on the ground light supporting stake element for use in transferring impact from the impact delivering tool to the ground light supporting stake element to drive that stake element into the ground, (h) the first cavity having an inner dimension as defined by the inner surface of the side wall of the first cavity which is larger than an outer dimension of the ground light supporting stake element so one end of the stake element is accommodated in the first cavity during use of the ground light supporting stake element setting element to drive the stake element into the ground, (i) a second blind ended bore defined in the cylindrical body adjacent to the second end of the cylindrical body, the second blind ended bore extending from the second end of the cylindrical body toward the first end of the cylindrical body in the direction of the longitudinal axis of the cylindrical body, (j) a second cavity defined by the second blind ended bore, the cylindrical body having a side wall with an inner surface located in the second cavity and a planar wall extending across the longitudinal axis of the cylindrical body, the inner surface of the side wall of the second cavity having an inner dimension, and (k) an annular impact receiving rim defined by the second end of the cylindrical body adjacent to the second blind ended bore, the annular rim being adapted to receive impact from the impact delivering tool when the ground light supporting stake element setting element is in use transferring impact from the impact delivering tool to the ground light supporting stake element, (l) an opening into the second cavity defined by the annular impact receiving rim defined by the second end of the cylindrical body, and (2) a bubble level unit accommodated in the second cavity of the tubular sleeve element and indicating the degree of levelness of the tubular sleeve element when the tubular sleeve element is in use transferring impact from the impact delivering tool to the ground light supporting stake element, the bubble level unit including (a) a cylindrical body having an outer dimension less than the inner dimension of the second cavity so the bubble level unit is accommodated in the second cavity during use of the ground light supporting stake element setting element to transfer impact from the impact delivering tool to the ground light supporting stake element, (b) a planar wall which abuts the planar wall of the second cavity when the bubble level unit is in place in the second cavity, (c) a bubble level system in the cylindrical body, and (d) a bubble viewing surface on the cylindrical body of the bubble level unit through which the bubble level system is viewed to determine levelness, and (e) the bubble level unit being located in the second cavity to be visible through the opening defined by the annular impact receiving rim on the second end of the cylindrical body during use of ground light supporting stake element setting element to drive the ground light supporting stake into the ground whereby the levelness of the impact receiving face of the ground light supporting stake can be monitored as the ground light supporting stake is driven into the ground.

3. The ground light supporting stake element setting unit defined in claim 2 wherein the ground light supporting stake unit setting unit further includes an adapter element which is positioned in the second cavity to be interposed between the body of the tubular sleeve element and the impact receiving planar face located on the ground light supporting stake element when the ground light supporting stake setting element is in place on the ground light supporting stake element for use in transferring impact from the impact delivering tool to the ground light supporting stake element to drive the ground light supporting stake element into the ground for adapting the size of the ground light supporting stake element setting unit to the size of a ground light supporting stake element.

4. In combination:

A) a ground light supporting stake element which supports a ground light above ground when in use and which includes (1) a tapered body, (2) a first end on the tapered body which leads the stake element into the ground when the stake unit is forced into the ground, (3) a pointed end on the first end of the tapered body, (4) a second end on the tapered body which is located above ground when the stake element is in use supporting a ground light, (5) a cylindrical section on the second end of the tapered body which is located above ground when the stake element is being driven into the ground for use and which has an outer dimension, (6) and impact receiving planar face located on the second end of the tapered body; and B) a ground light supporting stake element setting unit which is used to transfer impact from an impact delivering tool to the ground light supporting stake element to drive the ground light supporting element into the ground and which includes (1) a tubular sleeve element which has (a) cylindrical body, (b) a first end on the cylindrical body which is located adjacent to the second end of the tapered body of the stake element when the stake element setting element is in use transferring impact from the impact delivering tool to the stake element when the stake element is being driven into the ground, (c) a second end on the cylindrical body which is located to receive impact from the impact delivering tool when the stake element is being driven into the ground, (d) the cylindrical body having a longitudinal axis extending between the first end on the cylindrical body and the second end on the cylindrical body, (e) a first blind ended bore defined in the cylindrical body adjacent to the first end of the cylindrical body, the first blind ended bore extending from the first end of the cylindrical body toward the second end of the cylindrical body in the direction of the longitudinal axis of the cylindrical body, (f) a first cavity defined by the first blind ended bore, the cylindrical body having a side wall with an inner surface located in the first cavity and a planar impact transferring wall extending across the longitudinal axis of the cylindrical body, (g) the planar wall of the first cavity being adapted to abut the impact receiving planar face located on the second end of the tapered body when the ground light supporting stake element setting element is in place on the ground light supporting stake element for use in transferring impact from the impact delivering tool to the ground light supporting stake element to drive that stake element into the ground, (h) the first cavity having an inner dimension as defined by the inner surface of the side wall of the first cavity which is larger than the outer dimension of the cylindrical section on the second end of the tapered body of the ground light supporting stake element so the cylindrical section of the stake element is accommodated in the first cavity during use of the ground light supporting stake element setting element to drive the stake element into the ground, (i) a second blind ended bore defined in the cylindrical body adjacent to the second end of the cylindrical body, the second blind ended bore extending from the second end of the cylindrical body toward the first end of the cylindrical body in the direction of the longitudinal axis of the cylindrical body, (j) a second cavity defined by the second blind ended bore, the cylindrical body having a side wall with an inner surface located in the second cavity and a planar wall extending across the longitudinal axis of the cylindrical body, the inner surface of the side wall of the second cavity having an inner dimension, and (k) an annular impact receiving rim defined by the second end of the cylindrical body adjacent to the second blind ended bore, the annular rim being adapted to receive impact from the impact delivering tool when the ground light supporting stake element setting element is in use transferring impact from the impact delivering tool to the ground light supporting stake element, (l) an opening into the second cavity defined by the annular impact receiving rim defined by the second end of the cylindrical body, and (2) a bubble level unit accommodated in the second cavity of the tubular sleeve element and indicating the degree of levelness of the tubular sleeve element when the tubular sleeve element is in use transferring impact from the impact delivering tool to the stake element, the bubble level unit including (a) a cylindrical body having an outer dimension less than the inner dimension of the second cavity so the bubble level unit is accommodated in the second cavity during use of the ground light supporting stake element setting element to transfer impact from the impact delivering tool to the ground light supporting stake element, (b) a planar wall which abuts the planar wall of the second cavity when the bubble level unit is in place in the second cavity, (c) a bubble level system in the cylindrical body, and (d) a bubble viewing surface on the cylindrical body of the bubble level unit through which the bubble level system is viewed to determine levelness, and (e) the bubble level unit being located in the second cavity to be visible through the opening defined by the annular impact receiving rim on the second end of the cylindrical body during use of ground light supporting stake element setting element to drive the ground light supporting stake into the ground whereby the levelness of the impact receiving face of the ground light supporting stake can be monitored as the ground light supporting stake is driven into the ground.

5. The combination defined in claim 4 wherein the ground light supporting stake unit setting unit further includes an adapter element which is positioned in the second cavity to be interposed between the body of the tubular sleeve element and the impact receiving planar face located on the ground light supporting stake element when the ground light supporting stake setting element is in place on the ground light supporting stake element for use in transferring impact from the impact delivering tool to the ground light supporting stake element to drive the ground light supporting stake element into the ground for adapting the size of the ground light supporting stake element setting unit to the size of a ground light supporting stake element.

* * * * *